United States Patent [19]

Riggin

[11] 4,446,361

[45] May 1, 1984

[54] AIRCRAFT FLIGHT COMPUTER

[76] Inventor: Steven R. Riggin, 5315 E. Countryside, Wichita, Kans. 67218

[21] Appl. No.: 47,145

[22] Filed: Jun. 11, 1979

[51] Int. Cl.[3] ..... G06C 27/00

[52] U.S. Cl. ..... 235/78 N; 235/88 N

[58] Field of Search ..... 235/70 A, 70 C, 61 NV, 235/78 G, 78 M, 78 N, 83, 84, 88 G, 88 M, 88 N, 91 H, 121, 122; 116/309, DIG. 43, 230

[56] References Cited

U.S. PATENT DOCUMENTS 1,893,235 1/1933 Iverson ..... 235/78 N X 3,496,640 2/1970 Warner ..... 235/88 N 3,664,292 5/1972 Sherman ..... 116/230 X 3,957,199 5/1976 Hunter ..... 235/88 N X

*Primary Examiner*—L. T. Hix

*Assistant Examiner*—Benjamin R. Fuller

[57] ABSTRACT

The purpose of this invention is to provide an improved structure for a flight computer used by aircraft pilots. This improved computer structure is constructed of sheets of material fastened together in laminer fashion the outer surfaces containing formulas, graphs, etc. and the front side containing a rotating disk and cursor to aid in the solution of wind problems, and course plotting.

3 Claims, 12 Drawing Figures

Fig. 1
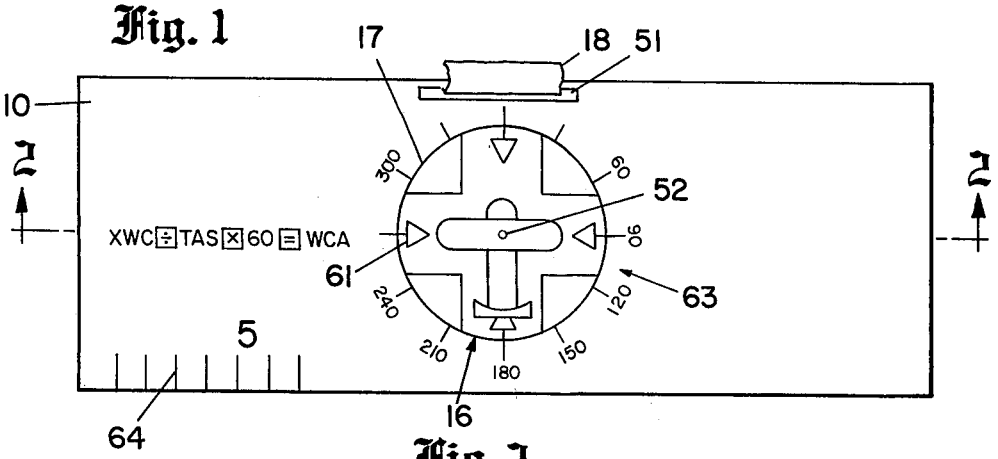
Fig. 2
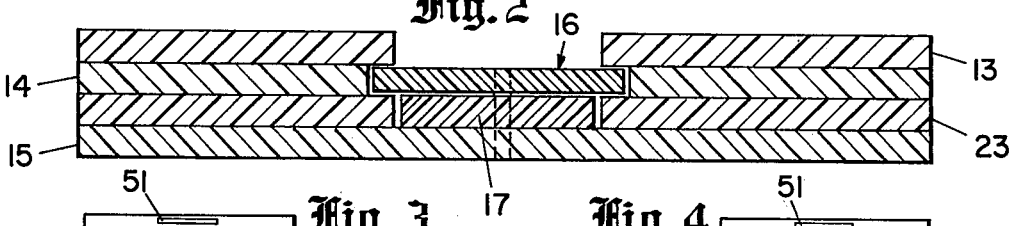
Fig. 3
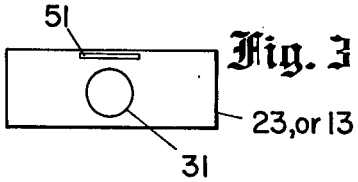
Fig. 4
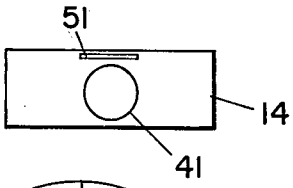
Fig. 5
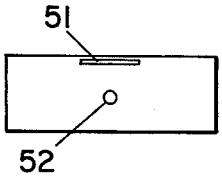
Fig. 6
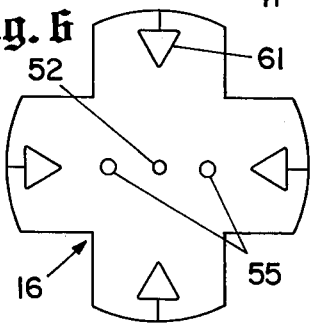
Fig. 9
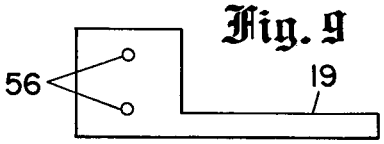
Fig. 10
XWC ÷ TAS × 60 = WCA
Fig. 8
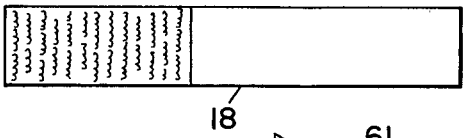
Fig. 11
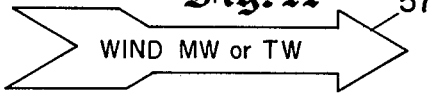
Fig. 12
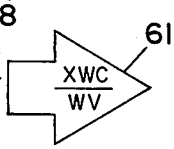

AIRCRAFT FLIGHT COMPUTER

PRIOR ART STATEMENT

In order to comply with the duty of disclosure CFR 1.56 practice the applicant discloses his knowledge of the following relevant prior art.

In 1976 the applicant began producing a device similar in concept to the subject matter of this application. The device manufactured under the trade name calculatorMATE consisted of a back plate, face plate, wind disk, aircraft course indicator and rivet. No patent application was ever filed on the device and no interference from existing patents was ever encountered.

CalculatorMATE is now in the public domain and directions and samples will be furnished if requested.

On June 5, 1979 a search of prior art U.S. Patents was conducted primarily in U.S. class 235 subclass 84. Most of the patents examined had rotary calculator disk members but were not deemed relevant in as much as they required a shaft through the circular disk structures to provide a means of interconnecting and combining the structures.

One U.S. Pat. No. 3,434,658 for a ROTARY INDICATOR was deemed relevant but not seen to interfere with any of the claims of the patent application.

BACKGROUND

This invention is directed to a mechanical computer designed to be easy to use and read but can be produced at low cost per unit.

The design of mechanical flight computers dates back nearly half a century. Early types were quite awkward and consisted of one side which was used for a graphical means of solving wind problems and another side which consisted of a slide rule device to solve time, speed, fuel consumption problems. Later types solved wind problems by a combination of graphical and mathematical methods which made the device less cumbersome.

The design of this flight computer is based upon the usage of formulas rather than a slide rule type device. Problems concerning time, speed, distance, etc. can be solved with either mental processes or a general purpose electronic calculator.

In the prior types of flight computers no device has ever been produced with the aircraft course indicator held radially by a retainer plate and prevented from axially moving by a face plate. This improvement prevents the outward edges of the aircraft course indicator from being bent upward.

SUMMARY

In order to aid in the understanding of this invention it can be stated in essentially summary form that it is directed to an aircraft flight computer constructed with a movable wind disk and aircraft course indicator in the center, both of which are imprinted with numbers and are rotatably mounted to aid the aircraft pilot in performing avigation calculations. The two outer surfaces of the device consist of a back plate and face plate which can be imprinted with graphs, scales, formulas, etc. Retainer plates are provided which have a circular hole in the center to hold the aircraft course indicator and wind disk. The device is constructed in a laminar fashion with the two retainer plates joined together and with the remaining sides joined to the back plate and the face plate.

Accordingly it is an object of this invention to provide a computer which can be constructed by mass production techniques to maintain a low cost of construction while providing the pilot with a simple and effective device to perform calculations necessary for safe and efficient avigation. It is a further object of this invention to provide a device that is durable and requires little maintenance. A further object of this invention is to provide the device which is imprinted to enable the pilot to plot courses.

Further objects and advantages of this invention will become apparent from the study of the following portion of the specification, the claims and the attached drawings.

BRIEF DESCRIPTION OF THE DRAWINGS

FIG. 1 is a top-plain view of an aircraft flight computer having a structure in accordance with this invention.

FIG. 2 is a sectional view taken generally along line 2—2 of FIG. 1.

FIG. 3 is a top-plain view of the wind disk retainer plate and face plate.

FIG. 4 is a top-plain view of the aircraft course indicator retainer plate.

FIG. 5 is a top-plain view of the back plate.

FIG. 6 is a top-plain view of the aircraft course indicator.

FIG. 8 is a top-plain view of the mounting strap.

FIG. 9 is a top-plain view of the course plotter arm.

FIG. 10 is a view of the formula representation system using a pictorial representation of pocket calculator keys.

FIG. 11 is a representation of a weather vane type arrow as it is imprinted on the wind disk.

FIG. 12 is a representation of the arrow and wind component symbol as it is imprinted on the aircraft course indicator.

DESCRIPTION

Figure 7:
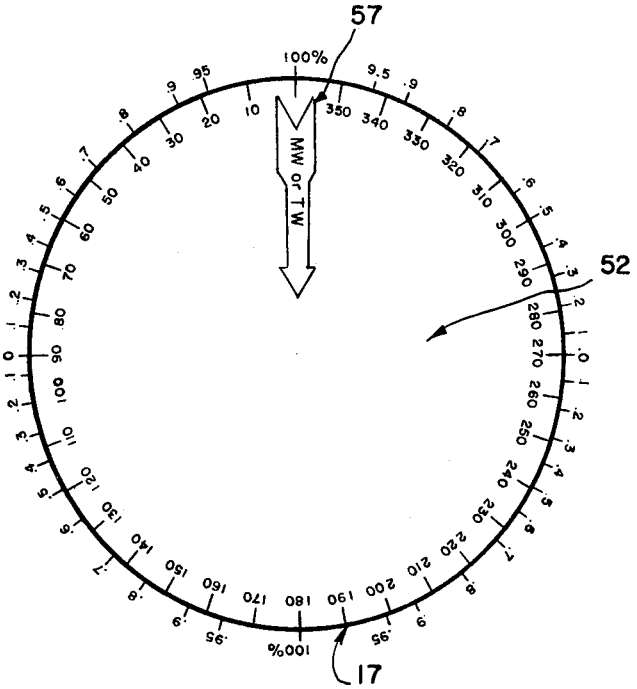
FIG. 7 is a top-plain view of the wind disk.

The aircraft flight computer of this invention is generally indicated at 10 in FIG. 1. Face plate 13 is fastened to aircraft course indicator retainer 14. The aircraft course indicator 16 is held radially by means of a cylindrical hole 41 in the aircraft course indicator retainer plate 14 as seen in FIG. 4. Upward axially movement of the aircraft course indicator 16 is prevented by face plate 13.

The wind disk retainer plate 23 is fastened preferably by adhesive substance to the aircraft course indicator retainer plate 14. In the preferred embodiment the cylindrical hole 31 in the wind disk retainer plate 23 is of a diameter smaller than that of the aircraft course indicator 16. The wind disk 17 is held radially by means of a cylindrical hole 31 in the wind disk retainer plate 23. In the preferred embodiment downward axially movement of the aircraft course indicator 16 is prevented by the wind disk retainer plate 23. Upward axially movement of the wind disk 17 is prevented by the aircraft course indicator 16. Downward axially movement of the wind disk 17 is prevented by the back plate 15. p The back plate 15 is fastened preferably by adhesive substance to the wind disk retainer plate 23. In the preferred embodiment the back plate is also imprinted with graphs and formulas.

In the preferred embodiment there are two holes 51 of identical dimensions and identical positions in the face plate 13, aircraft course indicator retainer plate 14, wind disk retainer plate 23, and back plate 15. The alignment of these holes 51 allows the mounting strap 18 to be threaded through the upper body and provides a secure means of holding the aircraft flight computer 10 by the mounting strap 18. In the preferred embodiment the free end of the mounting strap contains hook material cloth which can be attached to eye material affixed in the cockpit of the aircraft.

A hole 52 may be incorporated in the center of the wind disk 17, aircraft course indicator 16, and back plate 15. This hole 52 provides a means of inserting a pencil or suitable marking device to plot courses.

In the preferred embodiment the aircraft course indicator 16 is constructed from transparent material and imprinted with a pictorial diagram containing a plurality of arrows 61 of the type shown in FIG. 12. The aircraft course indicator of the preferred embodiment is constructed of a symmetrical cross shape with four elements as shown in FIG. 6. This shape of construction allows access to the wind disk so that it may be easily rotated. The aircraft course indicator may be fitted with a plurality of fasteners 55 to allow the course plotter 19 to be attached by means of corresponding holes 56.

In the preferred embodiment the wind disk 17 is imprinted with a weather vane type arrow 57 represented in FIG. 11. The wind disk of the preferred embodiment is also imprinted with a 360 degree circular gradient scale with numbers for each 10 degrees increasing in a counter clockwise direction.

In the preferred embodiment the aircraft flight computer 10 may be used to plot courses on aeronautical charts by means of first rotating the wind disk 17 until the tail of the weather vane type arrow 57 points horizontally towards the right of the aircraft flight computer 10. The aircraft course indicator 16 is then turned until the center of one element is aligned with the appropriate course imprinted on the circular gradient scale of the wind disk 17. The flight computer is then positioned so that the center of the element of the aircraft course indicator 16 is pointed in a North direction on the aeronautical chart. The desired course can then be plotted with a marking device along a horizontal edge of the aircraft flight computer 10.

In the preferred embodiment the face plate 13 of the aircraft flight computer 10 is imprinted with formulas comprising symbols which give a pictorial representation of pocket calculator keys as shown in FIG. 10.

The subject matter of the formulas imprinted on the face plate may be changed from time to time but it can be stated that it will generally include formulas for calculating windage, converting nautical miles to statute miles, doing temperature conversions, finding fuel required, groundspeed, and other formulas necessary for saft avigation. In the preferred embodiment the face plate is also imprinted with a circular gradient scale 63, graduated with degrees 0–359 increasing in a clockwise direction around the circumference of the circular hole 31 of FIG. 3.

The combination wind disk 17, aircraft course indicator 16, and the circular gradient scale imprinted on the face plate may be used to solve a variety of problems including holding patterns, ADF headings, Traffic pattern headings, and wind triangles. Since a comprehensive set of directions has been published and made available for sale for a predecessor flight computer no detailed explanation of these functions is seen to be required.

The face plate 13 of the preferred embodiment will also have the lower horizontal edge imprinted with a rule type milage scale 64, to aid in course plotting.

OPERATION OF THE INVENTION

The invention may be used to plot courses on charts as follows: the wind disk is rotated until the wind arrow is aligned opposite the 90° mark imprinted on the face plate. The aircraft course indicator is then rotated to indicate the course that is to be plotted by placing an arrow imprinted on one of the four elements over the course imprinted on the inner scale of the wind disk. The flight computer is then positioned on the chart so that the arrow over the desired course is aligned with the longitudinal axis on the chart. The desired course can then be plotted by drawing a writing instrument along the mileage scale imprinted on the lower horizontal edge of the flight computer. A plotter arm may also be attached to the aircraft course indicator.

The invention may also be used for solving wind problems and determining distance that can be flown with fuel on board. The wind problem is solved by first rotating the wind disk so that the wind arrow is aligned with the number indicating wind direction imprinted on the face plate.

The aircraft course indicator is similarly turned to indicate aircraft course. The numbers on the wind disk under the arrow on the aircraft course indicator can then be multiplied by the wind velocity to determine the value of the headwind or tailwind and crosswind present. The formulas imprinted on the face plate can then be used to determine the distance that can be flown by the aircraft with the fuel on board.

This invention having been described in its preferred embodiment, it is clear that it is susceptible to numerous modifications and embodiments within the ability of those skilled in the art without the exercise of the inventive faculty. Accordingly the scope of this invention is defined by the scope of the following claims.

I claim:

1. A laminated aircraft flight computer for use by aircraft pilots to plot courses, determine the effect of wind on the aircraft, determine headings for radio navigation, determine traffic pattern headings, and holding pattern headings assigned by the air traffic controller comprising:

A first structural member having a first substantially cylindrical opening, a planer bottom said opening having an axis of symmetry;

A second structural member fastened to said first structural member having a second substantially circular cylindrical opening coaxial with said first opening, said opening being larger than said first opening;

A first circular disk member having a radius substantially equal to the radius of said first opening for rotatable movement therein;

A second rotatable circular member having a radius substantially equal to the radius of said second opening, said second rotatable member positioned in said second opening substantially coaxial with said first rotatable member and overlaying the body thereof, said rotatable member adapted to permit access to said first rotatable member and is transparent;

A backplate member ridgidly attached to at least said first structural member, and preventing downward axial movement of said first rotatable member;

A retainer member rigidly attached to at least said second structural member, having a third circular opening therein for viewing predetermined indicia means imprinted on said first and second rotatable members; and said retainer member and said second structural member forming lip means for axially retaining said first and second rotatable members in their respective openings.

2. The flight computer of claim 1, wherein said first and second rotatable members are imprinted with indicia means representative of at least a circular gradient scale, weather vane symbol, and pictorial diagram comprising a plurality of arrows, and the outer surface of said retainer and backplate member provided with indicia means to coact with the indicia means on said first and second rotable members to facilitate the computation of flight data.

3. The flight computer of claim 2, wherein said third opening is coaxial with said first and second openings.

* * * * *